United States Patent [19]

Ma

[11] Patent Number: 4,567,871

[45] Date of Patent: Feb. 4, 1986

[54] FUEL DISTRIBUTION AND METERING

[75] Inventor: Thomas T. H. Ma, Chelmsford, England

[73] Assignee: Ford Motor Company, Dearborn, Mich.

[21] Appl. No.: 661,335

[22] PCT Filed: Sep. 27, 1984

[86] PCT No.: PCT/US84/01567

§ 371 Date: Sep. 27, 1984

§ 102(e) Date: Sep. 27, 1984

[87] PCT Pub. No.: WO85/01549

PCT Pub. Date: Apr. 11, 1985

[30] Foreign Application Priority Data

Sep. 28, 1983 [GB] United Kingdom ..... 8326023

[51] Int. Cl.[4] ..... F02M 7/093

[52] U.S. Cl. ..... 123/434; 123/438; 123/523; 123/524; 261/121 A; 261/40; 261/72 R

[58] Field of Search ..... 123/434, 438, 523, 524; 261/40, 72 R, 121 A

[56] References Cited

U.S. PATENT DOCUMENTS

| | | | |
|---|---|---|---|
| 1,365,661 | 1/1921 | Couldonise | 123/434 |
| 1,791,204 | 2/1931 | Harel | 261/40 |
| 1,845,668 | 2/1932 | Keil | 261/40 |
| 3,273,809 | 9/1966 | Morton | 261/40 |
| 3,419,251 | 12/1968 | Eckert | 261/40 |
| 3,841,613 | 10/1974 | Eckert | 261/40 |
| 4,399,794 | 8/1983 | Gagnon | 123/523 |

FOREIGN PATENT DOCUMENTS

| | | | |
|---|---|---|---|
| 652789 | of 0000 | France | 261/121 |
| 269470 | 10/1927 | United Kingdom | 123/434 |
| 278425 | 10/1927 | United Kingdom | 123/434 |
| 1434844 | 5/1976 | United Kingdom | 123/434 |
| 826063 | 4/1981 | U.S.S.R. . | |

*Primary Examiner*—Raymond A. Nelli

*Attorney, Agent, or Firm*—Clifford L. Sadler; Robert E. McCollum

[57] ABSTRACT

The invention relates to a fuel metering and distribution system for an internal combustion engine comprising an open fuel reservoir 18 into which fuel is metered and a set of capillary tubes 20 each extending from the fuel reservoir 18 to a point in an induction manifold adjacent the intake valve of a respective one of the engine cylinders. The fuel may either be metered by a carburettor-like arrangement drawing fuel from a float chamber or by means of a single solenoid valve connected between the reservoir and a source of fuel under pressure. The ends of the fine tubes terminate in the fuel reservoir immediately above the fuel level, whereby as the fuel rises, the additional fuel metered into the reservoir is sucked into the fine tubes and transferred directly to the engine cylinders.

7 Claims, 3 Drawing Figures

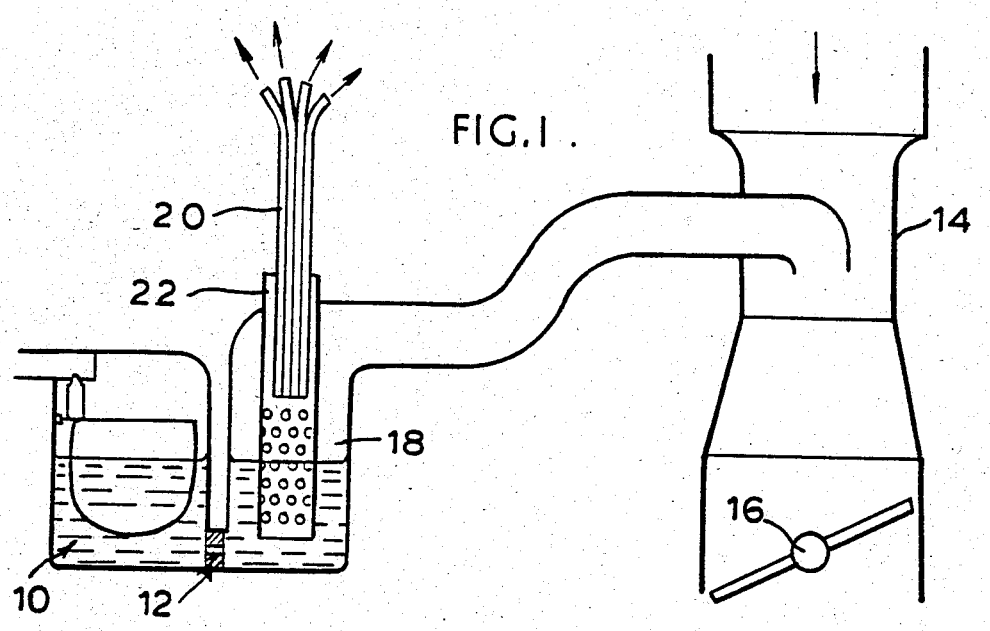
FIG. 1.
FIG. 2.
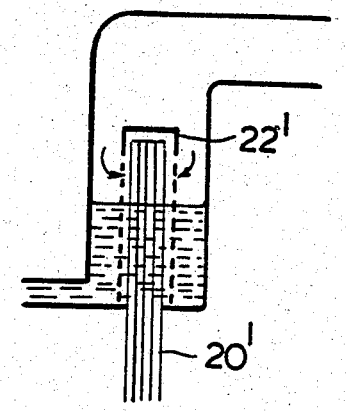
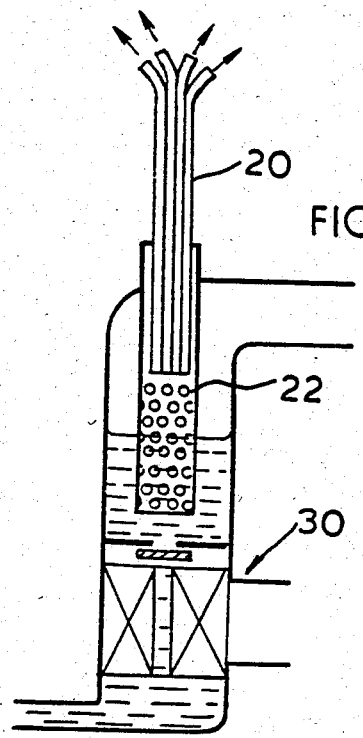
FIG. 3.

FUEL DISTRIBUTION AND METERING

The invention relates to the distribution and metering of fuel to the cylinders of a multi-cylinder internal combustion engine.

In order for an engine to operate efficiently, it is important for the mixture which it receives to be of the correct strength. Furthermore, in a multi-cylinder engine it is important to ensure that all cylinders receive comparable charges, i.e. the quantities of air as well as the mixture strengths received by the different cylinders should be the same.

In an engine in which fuel metering is effected by means of a single carburettor, the fuel mixture to all the cylinders should be the same but it is difficult to divide the charge equally between the cylinders. When several carburettors are provided, on the other hand, difficulty arises in balancing the mixture strength to all the cylinders. A still further problem with the use of carburettors is that fuel is present in the intake manifold and this can be troublesome if attempts are made to tune the manifold.

A fuel injection system has the advantage that the metering of the fuel is performed separately from the metering of the air supply to the cylinders. Thus the mixture strengths for the cylinders may be adjusted individually permitting more accurate control. Furthermore, the intake manifold design is simplified and the manifold is dry, which facilitates tuning of the manifold length and avoids the various problems caused by fuel in the manifold which tends to be deposited on the walls of the manifold and disturbs the mixture strength under transient conditions. The chief disadvantage of fuel injection, however, is the complexity, which is reflected in the cost and in reliability.

The present invention seeks to provide a system which offers the advantages of fuel injection but which may be implemented more simply.

According to the present invention, there is provided a fuel metering and distribution system for an internal combustion engine comprising an open fuel reservoir, a plurality of fine tubes each extending from the fuel reservoir to a point in an induction manifold adjacent the intake valve of a respective one of the engine cylinders, and means for introducing fuel into the reservoir at a controlled rate dependent upon the rate of air flow to engine cylinders, the ends of the fine tubes terminating in the fuel reservoir immediately above the fuel level, whereby as the fuel rises, the additional fuel metered into the reservoir is sucked into the fine tubes and transferred directly to the engine cylinders.

The fuel introduced at a controlled rate into the reservoir acts to raise the fuel level and the fine tubes which are under vacuum pressure draw the fuel so that once the fuel level in the reservoir attains equilibrium, all the fuel introduced into the reservoir is drawn by the intake manifold vacuum through the fine tubes to the cylinders while by-passing the air intake manifold. The fine tubes cannot however suck any more fuel than is metered into the reservoir.

An important feature of the air to fuel interface present within the reservoir is that it enables the cylinders to draw equal amounts of fuel from the reservoir without affecting the fuel metering function. In the absence of an air to fuel interface, such as if the reservoir is sealed or permitted to fill up with fuel then vacuum in the manifold would interfere with fuel metering and furthermore because the pressure cycles of the cylinders are not synchronised one cylinder may draw more of the metered fuel than the other cylinders.

The vacuum pressure in the manifold is sufficient to suck all the fuel from the reservoir without assistance under most operating conditions. However, to assist in the fuel transfer through the fine tubes under low vacuum conditions in the intake manifold, it is desirable to form a venturi in the intake manifold at the other end of each fine tube in order to reduce the pressure in the fine tubes.

It is also preferable, for the same reason, to arrange the reservoir at a level higher than the exit ends of the fine tubes so that gravity assists in the transfer by syphoning action.

Each tube may be provided with a respective reservoir but it is preferred for all the fine tubes of the different cylinders should be connected to a common fuel supply reservoir. To ensure that the cylinders should not suck different amounts of fuel, it is advantageous to form a perforated collar which dips below the fuel level and surrounds the ends of the fine tubes. The suction by the tubes in the perforated collar causes aeration and bubbling of the fuel and the fuel drawn through the fine tubes is mixed with air. Because the ends of the fine tubes need not now dip below the fuel level in the reservoir, there is no danger of uneven distribution through one fine tube drawing all the metered fuel and preventing the fuel level from reaching the remaining tubes.

The metering of fuel into the reservoir may be achieved by means of a conventional venturi in the intake manifold causing fuel to be drawn into the reservoir from a float chamber by way of a main metering jet. In other words, the metering may be performed by the conventional method used in carburettors thereby offering the advantage of few moving parts which makes for a cheaper and more reliable system. The fuel is however distributed separately to each individual cylinder and if desired the mixture strengths may be balanced by jets in the fine tubes.

Alternatively, fuel may be metered to the reservoir by means of a common solenoid valve, which retains the electronic control of fuel injection systems over the mixture strength while considerably simplifying the construction.

The invention will now be described further, by way of example, with reference to the accompanying drawings, in which:

FIG. 1 is a schematic representation of a fuel metering and distribution system in accordance with a first embodiment of the invention, and FIGS. 2 and 3 show details of alternative embodiments of the invention.

In FIG. 1, a metering system comprises a float chamber 10 which is similar to the float chamber of a conventional carburettor. A reservoir 18 is connected to the float chamber 10 by way of a main metering jet 12 and the reservoir 18 is connected to a venturi 14 in an air induction passage of the engine controlled by a butterfly valve 16.

In a conventional carburettor, essentially the same metering method is employed but the fuel which in the present invention enters the reservoir 18 is instead directly injected into the induction passage and is atomised. Consequently, the fuel passes along the same induction manifold as the air and as earlier mentioned this is disadvantageous for many reasons amongst which are the difficulty of achieving even mixture distribution because of wall-wetting caused by fuel separating out of the mixture and being deposited on the manifold wall.

The metering system illustrated in FIG. 1, is of a basic nature and is shown only to demonstrate the principle of operation. It will be clear that more advanced features of conventional carburettors, such as an acceleration pump, air bleed and emulsion tubes, a power valve, a choke etc., may also be incorporated, the essential difference being that the metered fuel is intercepted before being mixed with the air and is instead introduced into the reservoir 18 for transfer by means of the capillary tubes 20 directly to the intake valves of the cylinders.

In a conventional carburettor, the fuel metered to the engine during idling is not effected by means of the main jet but by a separate idling circuit which is sensitive to air flow in the vicinity of the butterfly valve. In adapting such a carburettor for multi-point fuel distribution during idling and normal running, it is necessary to provide two reservoirs, the first having fuel metered to it by the main jet and the second by the idling jet. In other words, any means employed in a conventional carburettor to meter fuel may be adapted for multi-point fueling as proposed by the present invention.

In the system of the present invention, the fuel from the reservoir 18 does not pass directly into the inducted air but is instead injected towards the end of the induction manifold adjacent the intake valves by means of the capillary tubes 20. The capillary tubes 20 terminate at a short distance above the fuel level in the fuel reservoir 18 and are surrounded by a perforated collar 22 which dips into the fuel. At their other ends, the tubes 20 open into the intake manifold and venturis are formed in the manifold in order to increase the vacuum pressure in the capillary tubes 20. Because of the high vacuum pressure in the capillary tubes 20, fluid is constantly sucked into the tubes and this reduces the pressure within the collar 20. As a result, air enters into the collar causing bubbling and aeration of the fuel and an air and fuel mixture reaches the level of the openings of all of the capillary tubes 20. Consequently, fuel is sucked into the tubes and delivered directly to the respective cylinders while bypassing the intake manifold.

The vacuum in the capillary tubes is sufficient to transport the fuel to the intake ports of the cylinders but because of the small diameter of the tubes the air quantity that is also sucked through the tubes is not great and does not interfere unduly with the metering of the fuel by the pressure signal from the metering venturi in the induction passage.

A problem which one might expect with the system of the invention is fuel starvation at high load since the vacuum pressure drops as the fuel requirement rises. To maximise the suction, the earlier described venturis are formed in the intake manifold at the end of the capillary tubes and additionally the reservoir 18 is arranged at a higher level than the intake manifold so that the fuel transfer is assisted by gravity. At higher load, the density of fuel in the capillary tubes increases automatically because of reduced aeration and as a result the efficiency of the syphoning action improves when it is most needed.

The tubes 20 are shown in FIG. 1 as arranged above the liquid level but in the alternative embodiment of the two the tubes 20' enter the reservoir from beneath and it is only the ends of the capillary tubes which lie above the liquid level. The operation of this embodiment is otherwise similar to that in FIG. 1 and a perforated collar 22' is still employed to cause bubbling at the air to fuel interface.

In FIG. 1, the fuel is metered into the reservoir 18 by a carburettor-like arrangement and all fuel entering the reservoir 18 is eventually transferred to the respective cylinders. As an alternative, electronic metering may be employed while still relying on the vacuum pressure to transfer the fuel to the individual cylinders and this is achieved in the embodiment of FIG. 3 by means of a solenoid valve 30 which is arranged between the reservoir and a source of fuel under high pressure, the solenoid 30 serving to meter controlled quantities of fuel to the reservoir. This offers advantages over a conventional fuel injection system that only a single injector is used.

Because individual capillary tubes are used to transfer fuel, it is possible if desired to control the fuel distribution between cylinders by differently sizing the capillary tubes 20 so as to vary the resistance to fuel flow in the different tubes.

It is now possible, because of the dry manifold, to incorporate the fuel metering and distribution system of the invention in an engine employing feedback, based for example on knock detection, flame propagation speed measurement etc., to vary the fueling in dependence upon the prevailing engine operating conditions. The dry manifold permits high calibration accuracy and fast response under transient conditions.

I claim:

1. A fuel metering and distribution system for an internal combustion engine comprising an open fuel reservoir, a plurality of fine tubes each extending from the fuel reservoir to a point in an induction manifold adjacent the intake valve of a respective one of the engine cylinders, and means for introducing fuel into the reservoir at a controlled rate dependent upon the rate of air flow to engine cylinders, the ends of the fine tubes terminating in the fuel reservoir immediately above the fuel level, whereby as the fuel rises, the additional fuel metered into the reservoir is sucked into the fine tubes and transferred directly to the engine cylinders.

2. A system as claimed in claim 1, wherein in order to assist in the fuel transfer through the fine tubes under low vaccum conditions in the intake manifold, a venturi is formed in the intake manifold at the other end of each fine tube in order to reduce the pressure in the fine tubes.

3. A system as claimed in claim 1 or 2, wherein the reservoir is arranged at a level higher than the exit ends of the fine tubes so that gravity assists in the transfer by syphoning action.

4. A system as claimed in claim 1, 2 or 3, wherein a perforated collar is provided surrounding the endds of the tubes in the reservoir and dipping below the fuel level, the suction by the tubes in the perforated collar being operative to cause aeration and bubbling of the fuel such that the fuel drawn through the fine tubes is mixed with air.

5. A system as claimed in any preceding claim, wherein the metering of fuel into the reservoir is achieved by sucking fuel into the reservoir from a float chamber by applying above the fuel level in the reservoir a low pressure derived from a venturi in the induction passage of the engine.

6. A system as claimed in any of claims 1 to 5, wherein fuel is metered to the reservoir by means of a common solenoid valve connected between the reservoir and a supply of fuel under pressure, the reservoir being open to atmospheric pressure above the fuel level.

7. A fuel metering and distribution system substantially as herein described with reference to and as illustrated in FIGS. 1, 2 or 3 of the accompanying drawings.

* * * * *